US007692540B2

(12) United States Patent
Doyle et al.

(10) Patent No.: US 7,692,540 B2
(45) **Date of Patent: *Apr. 6, 2010**

(54) PERIMETER SECURITY SYSTEM

(75) Inventors: Alan T. Doyle, Brookfield, WI (US); Alan C. Hay, Sullivan, WI (US)

(73) Assignee: Kelly Research Corp., Waukesha, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/245,033

(22) Filed: Oct. 3, 2008

(65) Prior Publication Data

US 2009/0072971 A1 Mar. 19, 2009

Related U.S. Application Data

(63) Continuation of application No. 11/398,784, filed on Apr. 6, 2006, now Pat. No. 7,450,006.

(51) Int. Cl.
*G08B 13/00* (2006.01)

(52) U.S. Cl. ..... 340/541; 340/506; 340/5.1; 340/10.1

(58) Field of Classification Search ..... 340/541, 340/508, 531, 506, 545.1, 545.9, 551–554, 340/539.7, 561, 565, 286.01, 5.1, 10.1
See application file for complete search history.

(56) References Cited

U.S. PATENT DOCUMENTS 4,857,912 A * 8/1989 Everett et al. ..... 340/508
5,202,661 A * 4/1993 Everett et al. ..... 340/522
5,485,142 A * 1/1996 Stute et al. ..... 340/506
5,977,871 A * 11/1999 Miller et al. ..... 340/506
6,288,640 B1 * 9/2001 Gagnon ..... 340/539.17
6,512,478 B1 * 1/2003 Chien ..... 342/357.09
6,621,947 B1 * 9/2003 Tapanes et al. ..... 385/12
6,664,894 B2 * 12/2003 Pakhomov ..... 340/541
6,778,469 B1 * 8/2004 McDonald ..... 367/136
6,778,717 B2 * 8/2004 Tapanes et al. ..... 385/12
6,816,073 B2 * 11/2004 Vaccaro et al. ..... 340/541
6,937,151 B1 * 8/2005 Tapanes ..... 340/550
6,956,478 B2 * 10/2005 Oyagi et al. ..... 340/541
6,980,483 B2 * 12/2005 McDonald ..... 367/93
7,049,952 B2 * 5/2006 Kulesz et al. ..... 340/506
7,161,483 B2 * 1/2007 Chung ..... 340/531
7,436,297 B1 * 10/2008 Tucker ..... 340/541

* cited by examiner

*Primary Examiner*—Davetta W Goins

(57) ABSTRACT

A method of operating a perimeter security system comprises monitoring a perimeter for a plurality of events, receiving an event signal for an event of the plurality of events wherein the event signal comprises an acceleration, processing the first event signal to determine if the event is a threat, transferring a confirmation request to confirm that the event is a threat in response to determining that the event is a threat, receiving a confirmation response in response to the confirmation request confirming that the event is a threat, and generating and transmitting a message identifying the event in response to confirming the threat.

5 Claims, 8 Drawing Sheets

PERIMETER SECURITY SYSTEM

RELATED APPLICATIONS

This patent application is a continuation of patent application Ser. No. 11/398,784; filed Apr. 6, 2006; entitled "DISTRIBUTED PERIMETER SECURITY THREAT CONFIRMATION;" and which is hereby incorporated by reference into this patent application.

TECHNICAL FIELD

The technical field relates to perimeter security networks, and in particular, to processing event signals to evaluate threat events.

BACKGROUND

Recently, many enterprises have become increasingly concerned with the issue of perimeter security. For example, military, municipal, and corporate enterprises desire to secure the perimeters of a wide variety of installations, such as airports, military bases, and corporate campuses.

Typically, perimeter security systems are arranged with multiple sensors arrayed along a boundary and in communication with a central control system. Often times, the sensors are mounted on a barrier, such a fence. In general, the sensors monitor the boundary for event signals, such as vibration and heat signals. Upon sensing an event signal, an alert signal is communicated from the sensors to a central control system.

In one example, the central control system alerts personnel to the occurrence of the event. The personnel are then tasked with investigating the event to evaluate whether or not the event is a security threat. One problem associated with this approach is that dispatching personnel to investigate non-threatening events wastes time and resources.

In a prior art solution to the problem of dispatching personnel to evaluate events, threat evaluation is performed at the central control system. In this manner, personnel will only be dispatched once an accurate threat evaluation has been performed by the central control system. However, threat evaluation processes often times lack accuracy. For example, a single faulty sensor could generate false data, thereby causing the central control system to generate a false alarm. In addition, many modern large scale perimeter security systems include thousands of sensors. In such an environment, the resources required to perform threat evaluation and confirmation are prohibitive.

Overview

Disclosed herein is a method of operating a perimeter security system, the method comprising monitoring a perimeter for a plurality of events, receiving an event signal for an event of the plurality of events wherein the event signal comprises an acceleration, processing the first event signal to determine if the event is a threat, transferring a confirmation request to confirm that the event is a threat in response to determining that the event is a threat, receiving a confirmation response in response to the confirmation request confirming that the event is a threat, and generating and transmitting a message identifying the event in response to confirming the threat.

BRIEF DESCRIPTION OF THE DRAWINGS

The same reference number represents the same element on all drawings.

DETAILED DESCRIPTION

FIGS. 1-8 and the following description depict specific embodiments to teach those skilled in the art how to make and use the best mode of the invention. For the purpose of teaching inventive principles, some conventional aspects have been simplified or omitted. Those skilled in the art will appreciate variations from these embodiments that fall within the scope of the invention. Those skilled in the art will appreciate that the features described below can be combined in various ways to form multiple embodiments of the invention. As a result, the invention is not limited to the specific embodiments described below, but only by the claims and their equivalents.

First Embodiment Configuration and Operation

FIGS. 1-3

Figure 1:
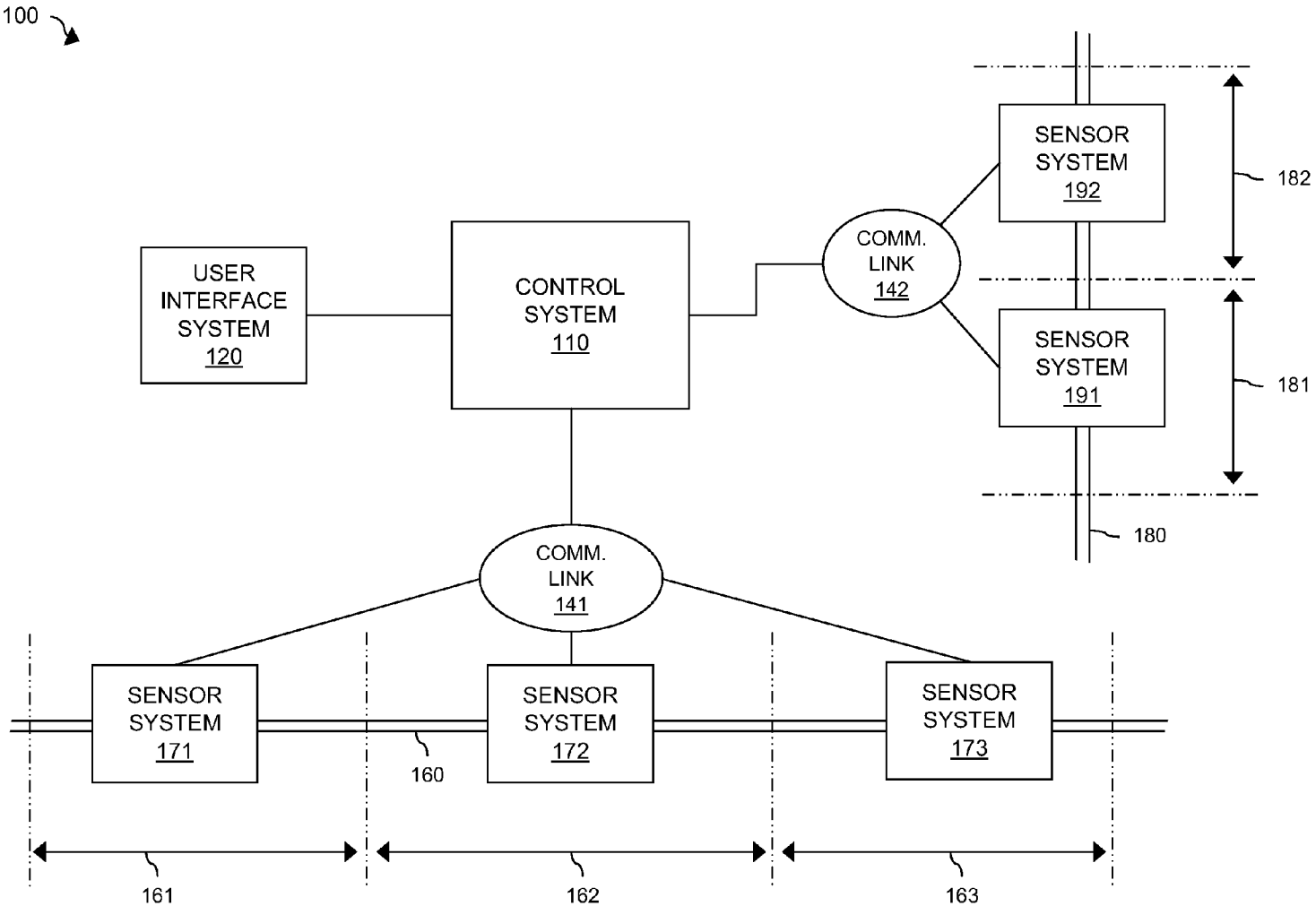
FIG. 1 illustrates a perimeter security network in an embodiment.

FIG. 1 illustrates perimeter security network 100 in an embodiment. Perimeter security network 100 includes control system 110, user interface system (UIS) 120, barrier 160, and barrier 180. Barrier 160 includes barrier segments 161, 162, and 163. Barrier 180 includes barrier segments 181 and 182. Sensor systems 171, 172, and 173 are coupled to barrier segments 161, 162, and 163 respectively. Sensor systems 191 and 192 are coupled to barrier segments 191 and 192 respectively. Sensor systems 171, 172, and 173 are in communication with control system 110 over communication link 141. Sensor systems 191 and 192 are in communication with control system 110 over communication link 142. It should be understood that, while illustrated as separate communication links, communication links 141 and 142 could comprise a single communication link.

Sensor systems 171-173 and 191-192 could be any sensor systems capable of performing remote threat evaluation of event signals generated by potential threat events. In an example, sensor systems 171-173 and 191-192 could be capable of receiving event signals for events, processing the event signals to determine whether or not the events are threats to a perimeter, and communicating with control system 110 over communication links 141 and 142 if the events are threats.

Control system 110 could be any system or collection of systems capable of communicating with sensor systems 171-173 and 191-192 and UIS 120. In an example, control system 110 could be capable of receiving threat messages from sensor systems 171-173 and 191-192 identifying threats and processing the threat messages to determine responses to the threats. For example, control system 110 could provide notification to UIS 120 of a threat, whereby UIS 120 could display the threat notification to a user. In another example, control system 110 could log threat messages for later security analysis.

UIS 120 could be any system capable of communicating with control system 110 and interfacing with a user. UIS 120 could be any type of device capable of interfacing to a user, such as a personal computer, work station, mobile work station, handheld device, phone, or pager, as well as other types of devices.

Figure 2:
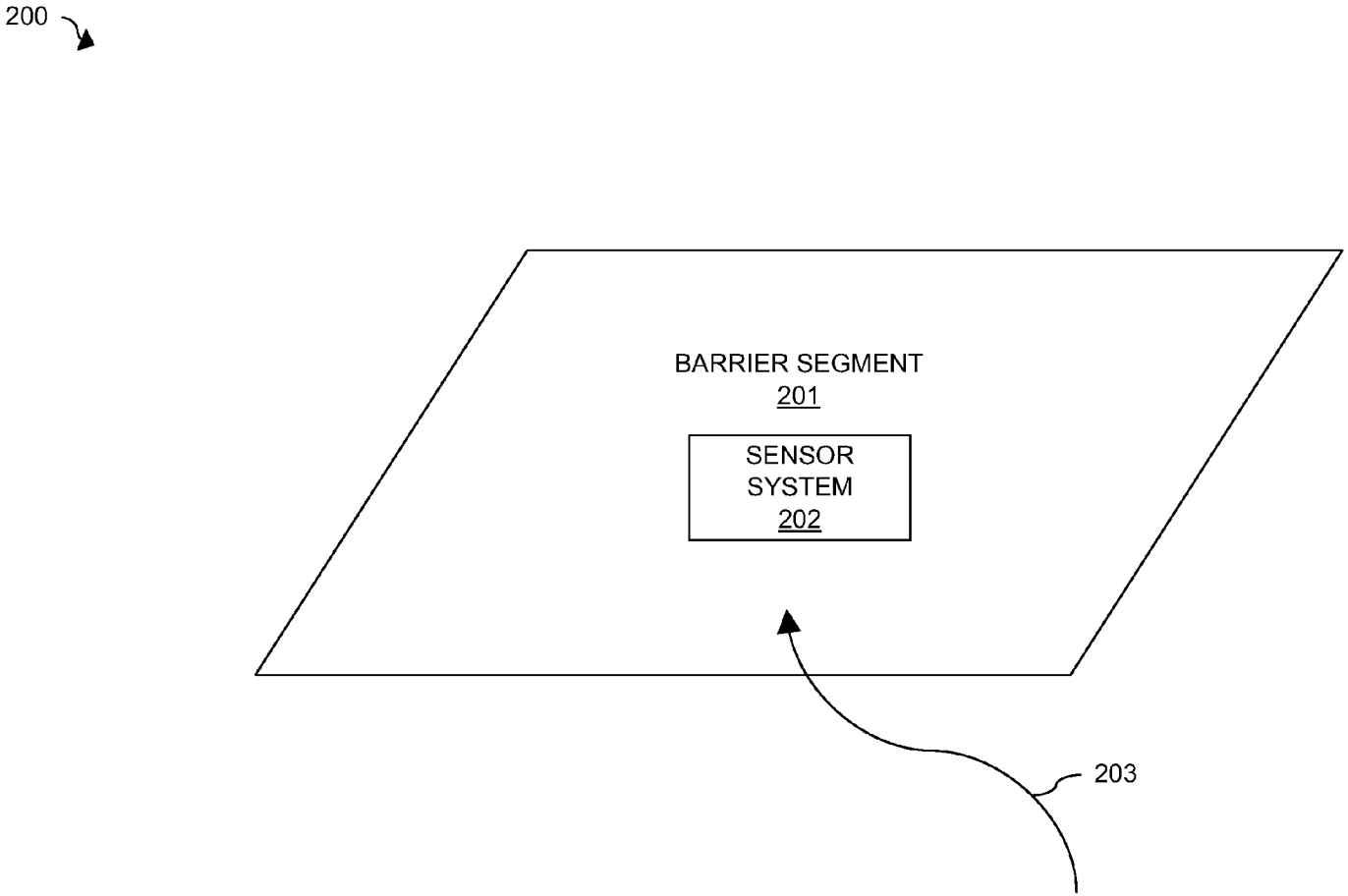
FIG. 2 illustrates a barrier system in an embodiment.

FIG. 2 illustrates barrier system 200. Barrier system 200 includes barrier segment 201, sensor system 202, and event 203 in an embodiment. Barrier segment 201 could be representative of barrier segments 161-163 and 181-182 as illustrated in FIG. 1. Sensor system 202 could be representative of sensor systems 171-173 and 191-192 as illustrated in FIG. 1.

It should be understood sensor system 202 could be coupled to barrier segment 201 in a manner well known in the art. As illustrated in FIG. 2, event 203 could cause an event signal to be generated on barrier segment 201. For example, event 203 could represent a weather force, such as wind, rain, or hail. The resulting vibration or acceleration of barrier segment 201 due to a weather force could be detectable by sensor system 202.

Figure 3:
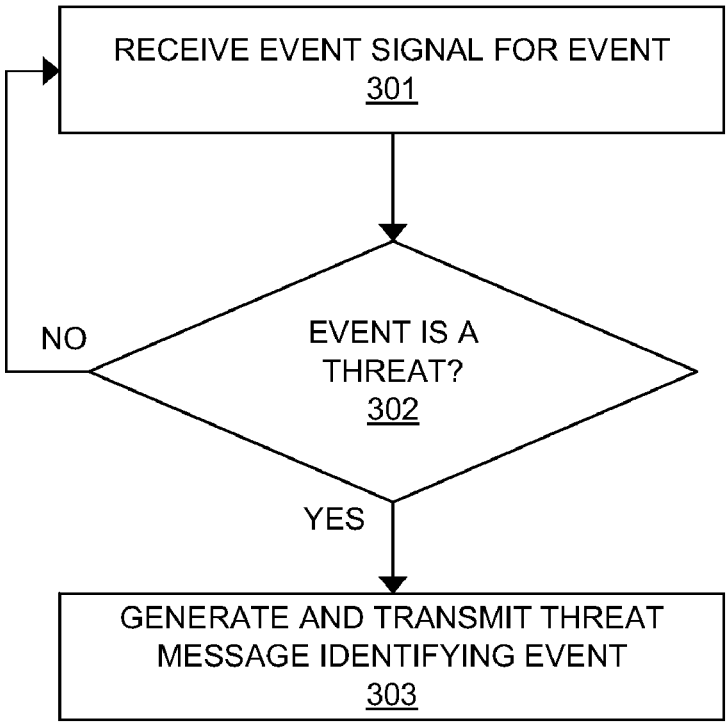
FIG. 3 illustrates the operation of a sensory system in an embodiment.

FIG. 3 illustrates a process describing the operation of sensor system 202 in an embodiment. The process illustrated in FIG. 3 could be representative of the operation of sensor systems 171-173 and 191-192. To begin, sensor system 202 receives a signal for an event (Step 301). For example, sensor system 202 could detect a vibration or acceleration in barrier segment 201. Next, sensor system 202 processes the signal to determine whether or not the event is a threat (Step 302). Upon determining that the event is a threat, sensor system 202 generates and transmits a threat message identifying the event (Step 303).

In an example, the event signal processed by sensor system 202 could indicate a pattern. It should be understood that sensor system 202 could determine whether the event is a threat based on the pattern contained in the signal. For instance, signal patterns caused by weather factors, such as wind or rain, could differ significantly from signal patterns caused by a person attempting to climb barrier segment 201. Sensor system 202 could compare, contrast, or otherwise process the event signal to discriminate between non-threat events, such as wind or rain, and threat events, such as intruders scaling a fence.

In an operational example, a perimeter security system could comprise multiple sensor systems arrayed along a perimeter, such as a border, boundary, or the like. The sensor systems could be coupled to a barrier, such a fence or a wall. For instance, the sensor systems could be mounted to a fence. Optionally, the sensor systems could be independent from a barrier, such as in the case of a video camera or infra-red sensor positioned distant from the perimeter, but directed to the perimeter. The sensor systems could be in communication with a central control system over a communication link. The communication link could be a wired or wireless communication link, or any combination thereof. An example of a wired communication link is an RS-485 link. The control system could be coupled to a user interface system, such as a work station. Personnel could monitor the user interface system for threat events occurring at the perimeter.

In operation, events will typically occur in a continuous fashion at the perimeter. For instance, in a case wherein a fence is positioned along a perimeter, weather, animal, or other environmental events will cause disturbances along the fence. For example, wind gusts could cause a disturbance to the fence. Likewise, small animals could disturb the fence, such as in the case of birds or other small animals climbing or resting on the fence. Such environmental events could be considered non-threat events.

Further in operation, events could occur that are not in accordance with non-threat events. Such non-environmental events could be considered threat events. For example, an intruder could attempt to enter the perimeter, such as by climbing a fence. In another example, an intruder could attempt to cut a fence.

Regardless of the type of event, a sensor system could detect, sense, measure, or otherwise receive signals created by an event. For example, disturbances translated to a fence by a threat or non-threat event could be measured in terms of vibration or acceleration, as well as by other factors.

In the prior art, a sensor system could transmit data corresponding to the event signals to a central control system for threat evaluation. In contrast, the present embodiment provides for evaluating data corresponding to the event signals at the sensor system. Upon receiving an event signal, the signal is converted to data in a digital form. The data is processed in the sensor system to determine whether the data contains a pattern consistent with non-threat environmental factors, such as wind, or consistent with threats, such as an intruder scaling a fence.

The evaluation result can then be provided to the central control system. The central control system can further provide the result to the user interface system. It should be understood that the central control system could optionally be combined with the user interface system in a single system.

Second Embodiment Configuration and Operation

FIGS. 4-7

Figure 4:
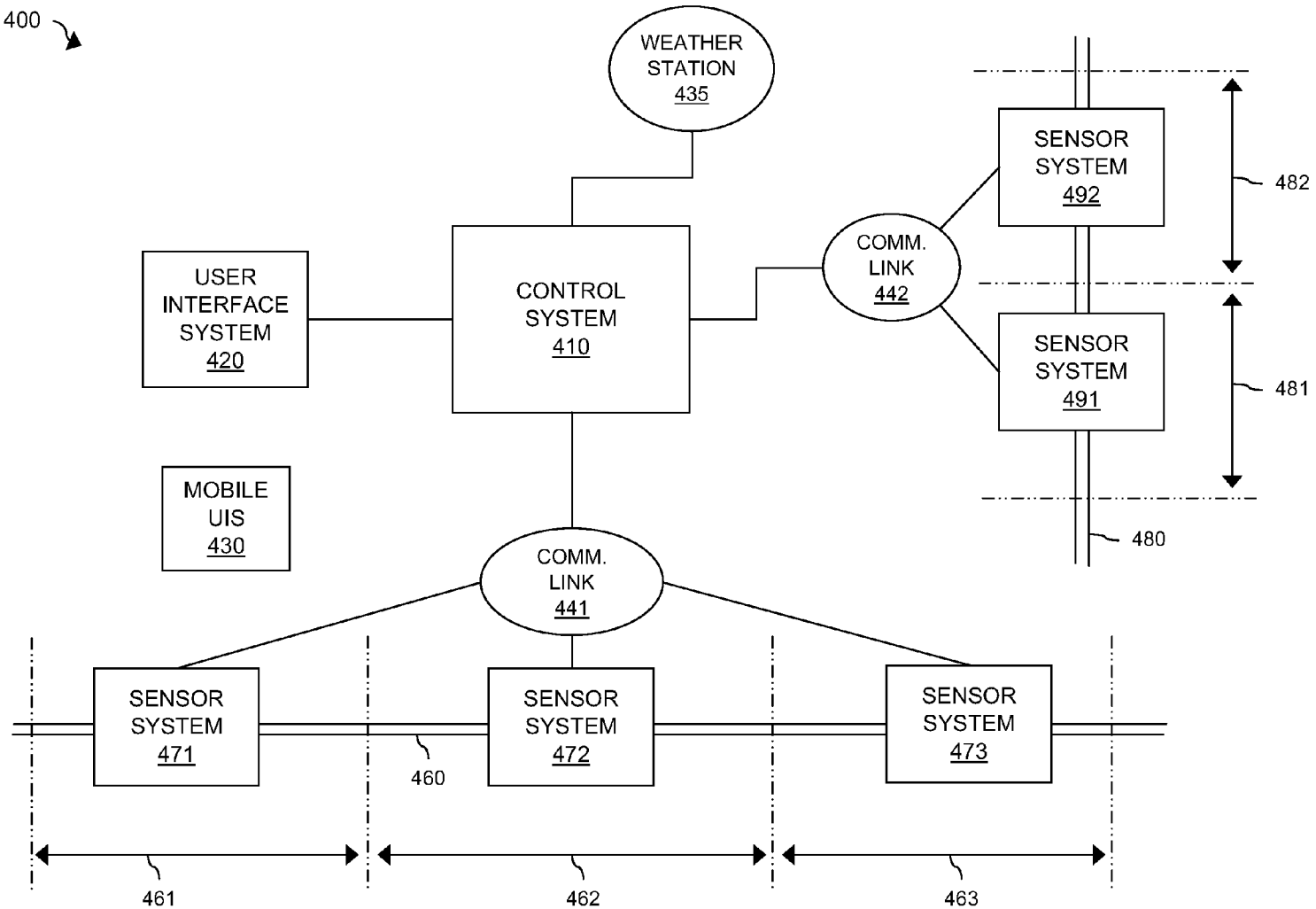
FIG. 4 illustrates a perimeter security network in an embodiment.

FIG. 4 illustrates perimeter security network 400 in an embodiment. Perimeter security network 400 includes control system 410, user interface system (UIS) 420, mobile UIS 430, barrier 460, barrier 480, and weather station 435. Barrier 460 includes barrier segments 461, 462, and 463. Barrier 480 includes barrier segments 481 and 482. Sensor systems 471, 472, and 473 are coupled to barrier segments 461, 462, and 463 respectively. Sensor systems 491 and 492 are coupled to barrier segments 491 and 492 respectively. Sensor systems 471, 472, and 473 are in communication with control system 410 over communication link 441. Sensor systems 491 and 492 are in communication with control system 410 over communication link 442. It should be understood that, while illustrated as separate communication links, communication links 441 and 442 could comprise a single communication link.

Sensor systems 471-473 and 491-492 could be any sensor systems capable of performing remote threat evaluation of event signals generated by potential threat events. In an example, sensor systems 471-473 and 491-492 could be capable of receiving event signals for events, processing the event signals to determine whether or not the events are threats to a perimeter, and communicating with control system 410 over communication links 441 and 442 if the events are threats.

Control system 410 could be any system or collection of systems capable of communicating with sensor systems 471-473 and 491-492, and UIS 420. It should be understood that control system 410 could be optionally capable of communicating with UIS 430. In an example, control system 410 could be capable of receiving threat messages from sensor systems 471-473 and 491-492 identifying threats and processing the threat messages to determine responses to the threats. For example, control system 410 could provide notification to UIS 420 or mobile UIS 430 of a threat, whereby UIS 420 or mobile UIS 430 could display the threat notification to a user.

In another example, control system 410 could log threat messages for later security analysis.

UIS 420 could be any system capable of communicating with control system 410 and interfacing with a user. UIS 420 could be any type of device capable of interfacing to a user, such as a personal computer or work station. Similarly, mobile UIS 430 could be any system capable of communicating with control system 410 and interfacing with a user. Mobile UIS 430 could be any type of device capable of interfacing to a user, such as a mobile work station, handheld device, phone, radio, or pager, as well as other types of mobile devices. UIS 430 could be in communication with control system 410 over a wireless communication link well known in the art.

Weather station 435 could be any system or collection of systems capable of collecting weather data and providing the weather data to sensor systems 471-473 and 491-492. It should be understood that weather station 435 could provide the weather data to control system 410, which in turn could distribute the weather data to sensor systems 471-473 and 491-492. While illustrated as coupled to control system 410, it should be understood that weather station 435 could be in communication with sensor systems 471-473 and 491-492 directly and could provide the weather data directly to sensor systems 471-473 and 491-492. Other variations are possible.

Figure 5:
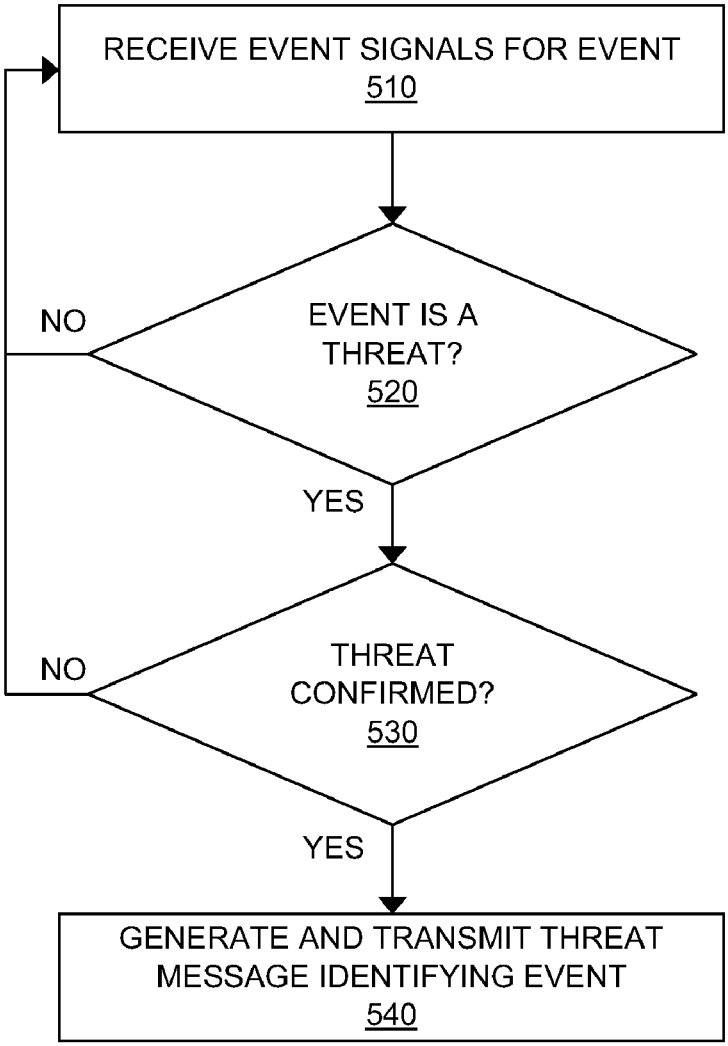
FIG. 5 illustrates the operation of a sensor system in an embodiment.

FIG. 5 illustrates the operation of sensor system 472 in an embodiment. FIG. 5 could be illustrative of the operation of sensor systems 471-473 and 491-492. To begin, sensor system 472 receives event signals for an event (Step 510). For example, a physical force could cause a disturbance on barrier 460, which in turn could be translated to barrier segment 462 and sensed by sensor system 472. Examples of such a force are weather activity, animal activity on barrier 460, or threatening human activity on barrier 460. Sensor system 472 could sense various characteristics of the physical disturbance to barrier 460, such as the magnitude of vibrations cased on barrier 460, or the acceleration of barrier 460 in a direction generally perpendicular to a vertical face of barrier 460, as well as other characteristics. Sensor system 472 could receive the event signal in an analog form and convert the event signal to a digital form for further processing.

Next, sensor system 472 processes the event signal to determine whether or not the event is a threat (Step 520). In one example, sensor system 472 processes the digital form of the event signal to determine a pattern or characteristic of the event signal. Sensor system 472 could then derive the type of the event based on the pattern or characteristic of the event signal. For instance, wind activity could create one pattern or characteristic, while human activity could create a different pattern or characteristic. In an example of the difference between wind activity and human activity, the acceleration of barrier 460 could generally be much greater in the case of human activity than in the case of wind activity. Likewise, the patterns or characteristics of benign animal activity could also differ significantly from the patterns or characteristics of threatening human activity, such as a human scaling barrier 460. Sensor system 472 could consider a threat any event that is determined to be human activity, whereas sensor system 472 could consider a non-threat any event that is determined to be benign weather or animal activity. If the event is not a threat, sensor system 472 could return to monitoring the perimeter for threats.

It should be understood that sensor system 472 could incorporate weather data provided by weather station 435 in evaluating the threat status of an event. For example, weather station 435 could provide data related to the direction and intensity or velocity of wind. Sensor system 472 could process the event signal in view of the weather data to differentiate between weather related events and human generated events.

Upon determining that the event is a threat, sensor system 472 proceeds to confirm that the event is a threat (Step 530). Upon receiving confirmation of a threat, sensor system 472 generates and transmits a threat message identifying the event as a threat (Step 540). In an example, sensor system 472 transmits the threat message to control system 410 for further processing.

Figure 6:
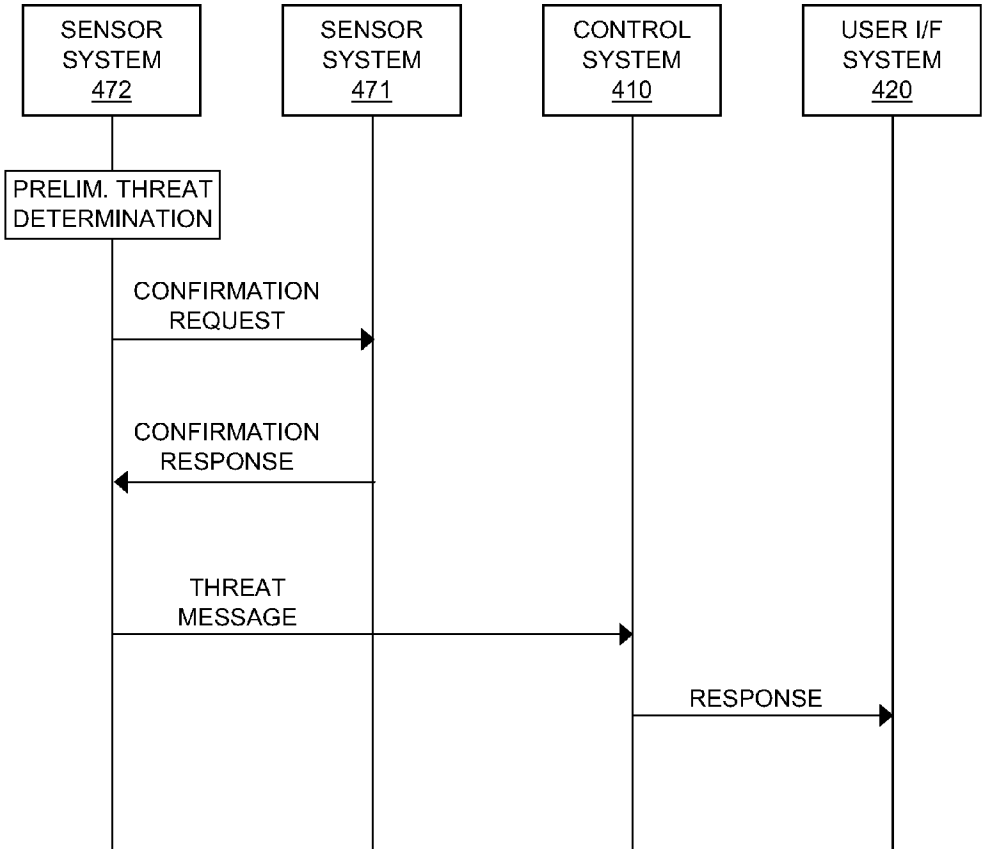
FIG. 6 illustrates the flow diagram in an embodiment.

FIG. 6 is a flow diagram that illustrates a possible example for confirming a threat. As illustrated by FIG. 6, sensor system 472 makes a preliminary threat determination of an event. Next, sensor system 472 generates and transmits a confirmation request to sensor system 471. The confirmation request could identify characteristics of the threat, such as the type of the threat, a time period within which the threat occurred, or a sample of the event signal, as well as other characteristics.

In response to the confirmation request, sensor system 471 provides a confirmation response confirming or denying the threat. For example, sensor system 471 could have sensed the same event as sensor system 472, but could have determined that the event was not a threat. In such a case, sensor system 471 could respond to the confirmation request with a denial. In yet another example, sensor system 471 could have sensed the same event as sensor system 472 and reached the same conclusion that the event is a threat. In such a case, sensor system 471 could transfer a confirmation response confirming the existence of the threat.

In response to receiving the threat confirmation, sensor system 472 could transmit a threat message identifying the threat to control system 410. Control system 410 could responsively processes the threat message to determine a response to the threat. As illustrated in FIG. 6, control system 410 transmits the response to user interface system 420. In one example, the response is a threat notification and user interface system 420 displays the threat notification to a user. It should be understood that control system 410 could also provide a threat notification to mobile UIS 430.

In yet another example, sensor system 471 could have an absence of information regarding the particular event referenced by the confirmation request. In such a case, sensor system 471 could provide a null response in the confirmation response indicating that no determination was reached regarding the threat status of the event.

In the event that the threat is not confirmed, sensor system 472 could generate and transmit an event message to control system 410 identifying the event. Control system 410 could take any number of actions in response to a non-threat event message, such as logging the occurrence of the event. Other responses are possible.

Figure 7:
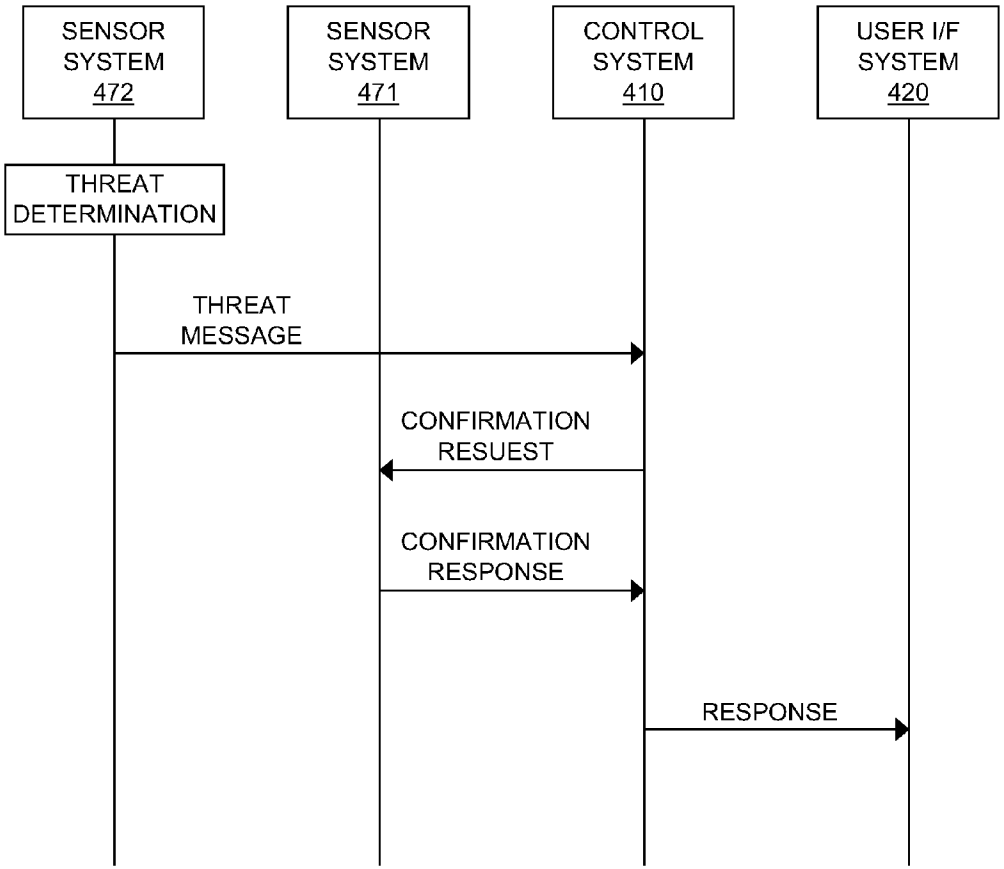
FIG. 7 illustrates the flow diagram in an embodiment.

FIG. 7 is a flow diagram that illustrates another possible example for confirming a threat. As illustrated by FIG. 7, sensor system 472 makes a preliminary threat determination of an event and transmits a threat message to control system 410. Next, control system 410 generates and transmits a confirmation request to sensor system 471. The confirmation request could identify characteristics of the threat, such as the type of the threat, a time period within which the threat occurred, or a sample of the event signal, as well as other characteristics.

In response to the confirmation request, sensor system 471 provides a confirmation response confirming or denying the threat. For example, sensor system 471 could have sensed the same event as sensor system 472, but could have determined that the event was not a threat. In such a case, sensor system 471 could respond to the confirmation request with a denial.

In yet another example, sensor system 471 could have sensed the same event as sensor system 472 and reached the same conclusion that the event is a threat. In such a case, sensor system 471 could transfer a confirmation response confirming the existence of the threat.

In response to receiving the threat confirmation, control system 410 could responsively processes the confirmation to determine a response to the threat. As illustrated in FIG. 7, control system 410 could transmit the response to user interface system 420. In one example, the response is a threat notification and user interface system 420 displays the threat notification to a user.

In yet another example, sensor system 471 could have an absence of information regarding the particular event referenced by the confirmation request. In such a case, sensor system 471 could provide a null response in the confirmation response indicating that no determination was reached regarding the threat status of the event. In such a case, control system 410 could query another sensor system of sensor systems 471-473 and 491-492 to confirm the threat. Optionally, control system 410 could transmit a confirmation request to sensor system 472 requesting sensor system 472 to confirm its own threat message. In the event that the threat is not confirmed, control system 410 could take any number of actions in response to a non-threat event message, such as logging the occurrence of the event. Other responses are possible.

Figure 8:
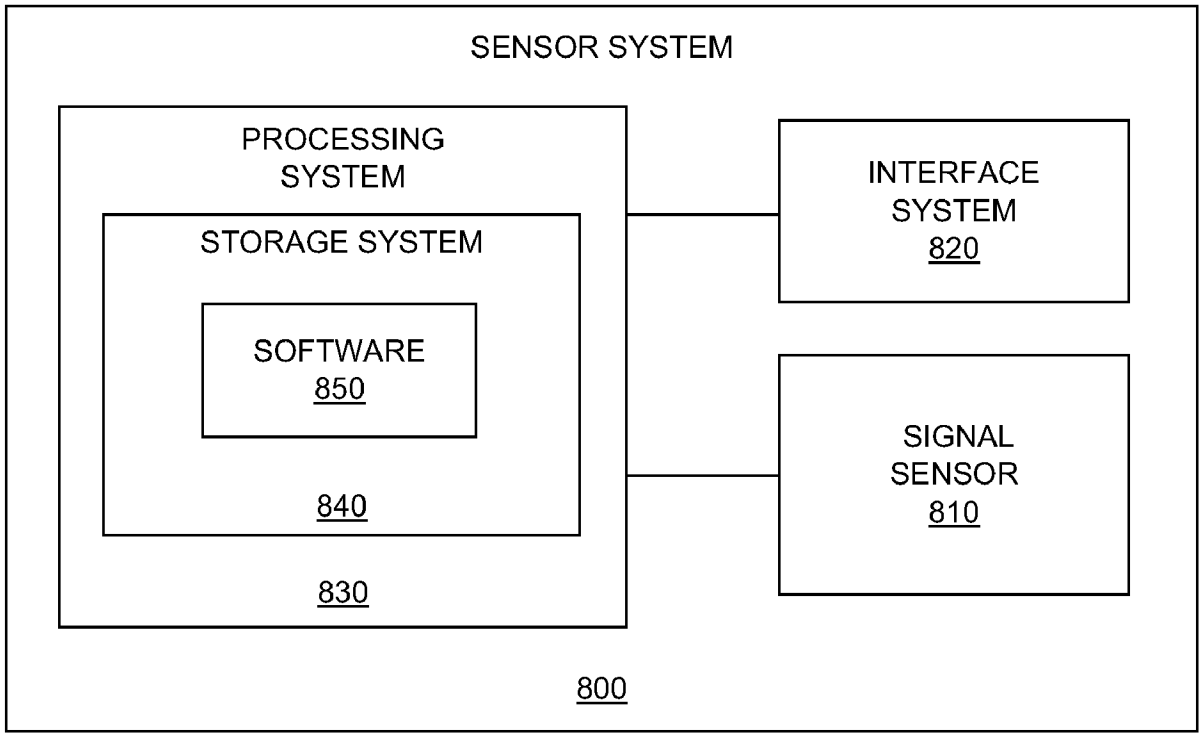
FIG. 8 illustrates a sensor system in an embodiment.

Sensor System—FIG. 8

FIG. 8 illustrates sensor system 800 in an embodiment. Sensor system 800 includes signal sensor 810, interface system 820, processing system 830, storage system 840, and software 850. Storage system 840 stores software 850. Processing system 830 is linked to interface system 820. Sensor system 800 could be comprised of a programmed general-purpose computer, although those skilled in the art will appreciate that programmable or special purpose circuitry and equipment may be used.

Interface system 820 could comprise a network interface card, modem, port, or some other communication device. Processing system 830 could comprise a computer microprocessor, logic circuit, or some other processing device. Processing system 830 could be distributed among multiple processing devices. Storage system 840 could comprise a disk, integrated circuit, or some other memory device. Storage system 840 could be distributed among multiple memory devices. Signal sensor 810 could comprise any sensor capable of sensing or receiving event signals, such as an accelerometer, a vibrometer, or an infra-red sensor. It should be understood that sensor system 800 could include multiple signal sensors.

Processing system 830 retrieves and executes software 850 from storage system 840. Software 850 may comprise an operating system, utilities, drivers, networking software, and other software typically loaded onto a general-purpose computer. Software 850 could also comprise an application program, firmware, or some other form of machine-readable processing instructions. When executed by the processing system 830, software 850 directs processing system 830 to operate as described for sensor system 202, sensor systems 171-173 and 191-192, and sensor systems 471-473 and 491-492.

What is claimed is:

1. A method of operating a perimeter security system, the method comprising:

monitoring a perimeter for a plurality of events;

receiving an event signal for an event of the plurality of events wherein the event signal comprises an acceleration;

processing the first event signal to determine if the event is a threat;

transferring a confirmation request to confirm that the event is a threat in response to determining that the event is a threat;

receiving a confirmation response in response to the confirmation request confirming that the event is a threat; and generating and transmitting a message identifying the event in response to confirming the threat.

2. The method of claim 1 further comprising receiving the message and displaying a threat notification.

3. The method of claim 1 wherein the acceleration comprises an acceleration of a barrier forming a portion of the perimeter.

4. A perimeter security network comprising:

a sensor system configured to monitor a perimeter for a plurality of events, receive an event signal for an event of the plurality of events wherein the event signal comprises an acceleration, process the first event signal to determine if the event is a threat, transfer a confirmation request to confirm that the event is a threat in response to determining that the event is a threat, receive a confirmation response in response to the confirmation request confirming that the event is a threat; and generate and transmit a message identifying the event in response to confirming the threat; and a user interface system configured to receive the message and display a threat notification.

5. The perimeter security network of claim 4 wherein the acceleration comprises an acceleration of a barrier forming a portion of the perimeter.

* * * * *